US009481382B2

(12) United States Patent
Gregar et al.

(10) Patent No.: US 9,481,382 B2
(45) Date of Patent: Nov. 1, 2016

(54) HANDBRAKE WITH A DOUBLE-SIDED GEAR BOX

(71) Applicant: Wabtec Holding Corp., Wilmerding, PA (US)

(72) Inventors: Peter Paul Gregar, Chesterton, IN (US); Richard Wayne Plegge, Palatine, IL (US); Scott Lee Natschke, Bourbonnais, IL (US)

(73) Assignee: Wabtec Holding Corp., Wilmerding, PA (US)

( * ) Notice: Subject to any disclaimer, the term of this patent is extended or adjusted under 35 U.S.C. 154(b) by 155 days.

(21) Appl. No.: 14/250,690

(22) Filed: Apr. 11, 2014

(65) Prior Publication Data

US 2014/0305240 A1 Oct. 16, 2014

Related U.S. Application Data

(60) Provisional application No. 61/811,188, filed on Apr. 12, 2013.

(51) Int. Cl.
*B61H 13/04* (2006.01)
*B61H 13/02* (2006.01)

(52) U.S. Cl.
CPC ..... *B61H 13/04* (2013.01); *B61H 13/02* (2013.01); *Y10T 74/19679* (2015.01); *Y10T 74/2186* (2015.01)

(58) Field of Classification Search
CPC B61H 13/02; B61H 13/04; Y10T 74/19647; Y10T 74/19679; Y10T 74/2048
See application file for complete search history.

(56) References Cited

U.S. PATENT DOCUMENTS

| | | | | |
|---|---|---|---|---|
| 2,047,168 | A * | 7/1936 | O'Connor | B61H 13/04 74/505 |
| RE21,460 | E * | 5/1940 | O'Cconnor | B61H 13/04 74/505 |
| 2,210,740 | A * | 8/1940 | Van Cleave | B61H 13/04 74/505 |
| 4,368,648 | A | 1/1983 | Housman et al. | |
| 5,127,283 | A | 7/1992 | O'Brien et al. | |
| 6,170,619 | B1 | 1/2001 | Sheriff et al. | |
| 6,179,093 | B1 | 1/2001 | Daugherty, Jr. | |
| 6,578,679 | B2 | 6/2003 | Hill et al. | |

(Continued)

OTHER PUBLICATIONS

Cardwell Westinghouse, Double Sided Hand Brakes, http://www.wabtec.com/main/product.asp?id=2&product_id=676&nav_src=divisions&nav_src_2=products, 1994.

*Primary Examiner* — Nicholas J Lane
(74) *Attorney, Agent, or Firm* — The Webb Law Firm

(57) ABSTRACT

A handbrake for a railroad car includes a handbrake body having one or more gear train components therein and a drive shaft operatively connected to the one or more gear train components. An intermediate pinion shaft is operatively connected to the drive shaft through one or more gears. A shaft alignment link is adapted for maintaining a relative spacing between the drive shaft and the intermediate pinion shaft during rotation of the drive shaft. A gear box housing is provided to enclose at least a portion of the drive shaft, the intermediate pinion shaft, and the shaft alignment link. The shaft alignment link is movable relative to the gear box housing due to any eccentric movement of the drive shaft to maintain the proper spacing between the drive shaft and the intermediate pinion shaft, thereby eliminating a possibility of gear binding. A method for aligning internal gear components within a handbrake and an alignment system for use with a railway vehicle handbrake is also provided.

17 Claims, 3 Drawing Sheets

(56) References Cited

U.S. PATENT DOCUMENTS

| | | | |
|---|---|---|---|
| 7,011,190 | B2 | 3/2006 | Moriarity et al. |
| 7,487,695 | B2 | 2/2009 | Sommerfeld et al. |
| 8,307,955 | B2 | 11/2012 | Sommerfeld et al. |
| 8,616,341 | B2 | 12/2013 | Gregar |
| 2008/0110702 | A1 | 5/2008 | Sommerfeld et al. |
| 2008/0223669 | A1 | 9/2008 | Kanjo |
| 2008/0296122 | A1 | 12/2008 | Michel |
| 2012/0205200 | A1 | 8/2012 | Gregar |

* cited by examiner

HANDBRAKE WITH A DOUBLE-SIDED GEAR BOX

CROSS REFERENCE TO RELATED APPLICATIONS

This application is based upon U.S. Provisional Patent Application Ser. No. 61/811,188 entitled "Handbrake with a Double-Sided Gear Box", filed Apr. 12, 2013, which is hereby incorporated by reference in its entirety.

BACKGROUND OF THE INVENTION

1. Field of the Invention

The present disclosure is directed to a handbrake for a railway vehicle that includes a double-sided gear box that facilitates operation from either of the lateral sides of the car body and, further, to a handbrake for a railway vehicle that has a double-sided gear box having a design that compensates for eccentricity of the handbrake drive shaft while maintaining proper gear train spacing.

2. Description of Related Art

Railway vehicle handbrake mechanisms are well-known in the art. A conventional handbrake mechanism is disposed on the railroad vehicle and includes a rotatable hand wheel mounted on a shaft which, through a gear train, rotates a chain drum. Rotation of the chain drum winds up a chain that is secured to the brake rigging of the railroad car. The brakes are applied as the hand wheel is rotated in a first direction. Rotation of the hand wheel in a second direction opposite to the first direction is prevented by a mechanism which engages the hand wheel shaft. By disengaging the mechanism, the brakes can be released.

Existing handbrake designs with a double sided gear box are associated with a number of disadvantages. Internal gear components within the handbrake assembly must be aligned to allow for proper gear meshing and prevent binding of the gears. Typically, the internal gear components are adjusted during manufacture to ensure the proper gear meshing. After the initial adjustment, having no feasible method of in-field adjustments to prevent misalignment of the gear components, often results in handbrake failure. Certain handbrake mechanisms have a bearing cup welded to the handbrake back plate to position the intermediate pinion shaft in relation to the handbrake drive shaft to prevent relative misalignment. However, manufacturing tolerances in the drive shaft machining can create an eccentric path of the mating pinion gear. The fixed location of the intermediate pinion shaft in combination with an eccentric gear path often leads to gear train binding.

SUMMARY OF THE INVENTION

In view of the disadvantages of the existing handbrake mechanisms for railroad vehicles, there is a need in the art for an improved handbrake gear box mechanism that aligns all the gear box components during the initial assembly process. There is an additional need for an improved handbrake mechanism that eliminates gear train binding caused by manufacturing variations, bearing cup welding and/or drive shaft machining.

In accordance with one embodiment, a handbrake for a railroad car may include a handbrake body having one or more gear train components therein and a drive shaft operatively connected to the one or more gear train components. An intermediate pinion shaft may be operatively connected to the drive shaft through one or more gears. A shaft alignment link may be adapted for maintaining a relative spacing between the drive shaft and the intermediate pinion shaft during rotation of the drive shaft. A gear box housing may be provided to enclose at least a portion of the drive shaft, the intermediate pinion shaft, and the shaft alignment link. The shaft alignment link may be movable relative to the gear box housing due to any eccentric movement of the drive shaft to maintain the proper spacing between the drive shaft and the intermediate pinion shaft, thereby eliminating a possibility of gear binding.

The intermediate pinion shaft is operatively connected to the drive shaft through one or more gears. The one or more gears can include a pinion gear associated with the drive shaft and an intermediate pinion shaft gear associated with the intermediate pinion shaft. The shaft alignment link is adapted to prevent the pinion gear and the intermediate pinion shaft gear from binding. The shaft alignment link includes a first portion having a first opening and a second portion having a second opening. The first opening is configured for receiving the drive shaft and the second opening is configured for receiving the intermediate pinion shaft.

The handbrake can also include a drive shaft bushing located within the first opening of the shaft alignment link and a second pinion shaft bushing located within the second opening of the shaft alignment link. The handbrake can also include a gear box housing associated with the handbrake body. The gear box housing is configured to enclose at least the shaft alignment link and can include an opening configured to receive an upper portion of the intermediate pinion shaft. This opening can contain a first pinion shaft bushing therein. The gear box housing can have a shape and footprint substantially corresponding to a shape and footprint of the shaft alignment link.

The handbrake can include at least a first set of ribs extending between the gear box housing and the shaft alignment link to define a clearance space between a portion of the gear box housing and the shaft alignment link. The clearance space can be configured to compensate for eccentric rotation of the drive shaft and movement of the first portion of the shaft alignment link with respect to the gear box housing. The handbrake can also include a second set of ribs extending between the gear box housing and the shaft alignment link. This second set of ribs can be associated with a second portion of the shaft alignment link and can be configured to limit rotational movement of the second portion of the shaft alignment link with respect to the gear box housing.

In accordance with another embodiment, a method for aligning internal gear components within a handbrake includes providing a handbrake body having one or more gear train components therein, operatively connecting a drive shaft to the one or more gear train components, operatively connecting an intermediate pinion shaft to the drive shaft, and associating a shaft alignment link with the drive shaft and the intermediate pinion shaft. The shaft alignment link is adapted for maintaining a relative spacing between the drive shaft and the intermediate pinion shaft during rotation of the drive shaft.

The intermediate pinion shaft can be operatively connected to the drive shaft through one or more gears. The one or more gears can include a pinion gear associated with the drive shaft and an intermediate pinion shaft gear associated with the intermediate pinion shaft. The shaft alignment link is adapted to prevent the pinion gear and the intermediate pinion shaft gear from binding.

The shaft alignment link can include a first portion having a first opening and a second portion having a second opening. The first opening can be configured for receiving the drive shaft and the second opening can be configured for receiving the intermediate pinion shaft. The method can also include providing a drive shaft bushing within the first opening of the shaft alignment link and a second pinion shaft bushing within the second opening of the shaft alignment link.

The method can further include associating a gear box housing with the handbrake body such that the gear box housing encloses at least the shaft alignment link. The gear box housing includes at least one opening extending through a wall portion which is configured for receiving an upper portion of the intermediate pinion shaft.

The method can also include providing a first and second set of ribs between the gear box housing and the shaft alignment link. The first set of ribs can define a clearance space between a portion of the gear box housing and a portion of the shaft alignment link to compensate for eccentric rotation of the drive shaft and movement of the first portion of the shaft alignment link with respect to the gear box housing. The second set of ribs can extend between the gear box housing and a second portion of the shaft alignment link to limit rotational movement of the second portion of the shaft alignment link with respect to the gear box housing.

In accordance with yet another embodiment, an alignment system for use with a railway vehicle handbrake includes a shaft alignment link having a first portion and a second portion. The first portion has a first opening extending therethrough configured for receiving a drive shaft. The second portion has a second opening extending therethrough configured for receiving an intermediate pinion shaft and the shaft alignment link is associated with the backplate of the handbrake. The shaft alignment link maintains the relative spacing between the drive shaft and the intermediate pinion shaft during rotation of the drive shaft within the handbrake. The alignment system can also include a gear box housing associated with the handbrake to enclose at least the shaft alignment link. The gear box housing can have a shape and footprint essentially corresponding to a shape and footprint of the shaft alignment link. The gear box housing can include at least one opening extending through a wall portion which is configured for receiving an upper portion of the intermediate pinion shaft.

The alignment system can also include at least a first set and a second set of ribs located between the gear box housing and the shaft alignment link. The first set of ribs define a clearance space between a portion of the gear box housing and a portion of the shaft alignment link to allow the shaft alignment link to float which compensates for eccentric rotation of the drive shaft and movement of the first portion of the shaft alignment link with respect to the gear box housing. The second set of ribs extend between the gear box housing and a second portion of the shaft alignment link to limit rotational movement of the second portion of the shaft alignment link with respect to the gear box housing.

These and other features and characteristics of the handbrake having a double-sided gear box, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only, and are not intended as a definition of the limits of the invention. As used in the specification and the claims, the singular form of "a", "an", and "the" include plural referents unless the context clearly dictates otherwise.

DESCRIPTION OF THE PREFERRED EMBODIMENTS

Figure 1:
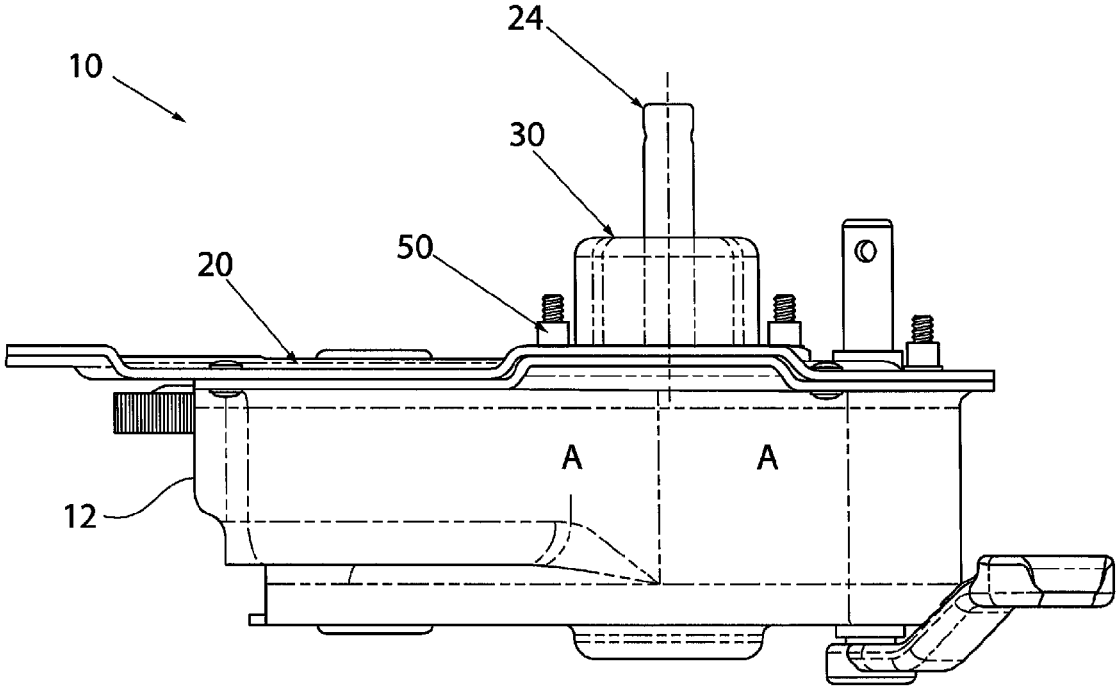
FIG. 1 is a side view of an assembled handbrake having a double-sided gear box in accordance with one embodiment.

For purposes of the description hereinafter, the terms "upper", "lower", "right", "left", "vertical", "horizontal", "top", "bottom", "lateral", "longitudinal", and derivatives thereof, shall relate to the invention as it is oriented in the drawing figures. However, it is to be understood that the invention may assume alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

Referring to the drawings in which like reference characters refer to like parts throughout the several views thereof, the present disclosure is generally directed to a handbrake for a railway car having a shaft alignment link to control the spacing of the gear train components and ensure proper gear meshing.

Figure 2:
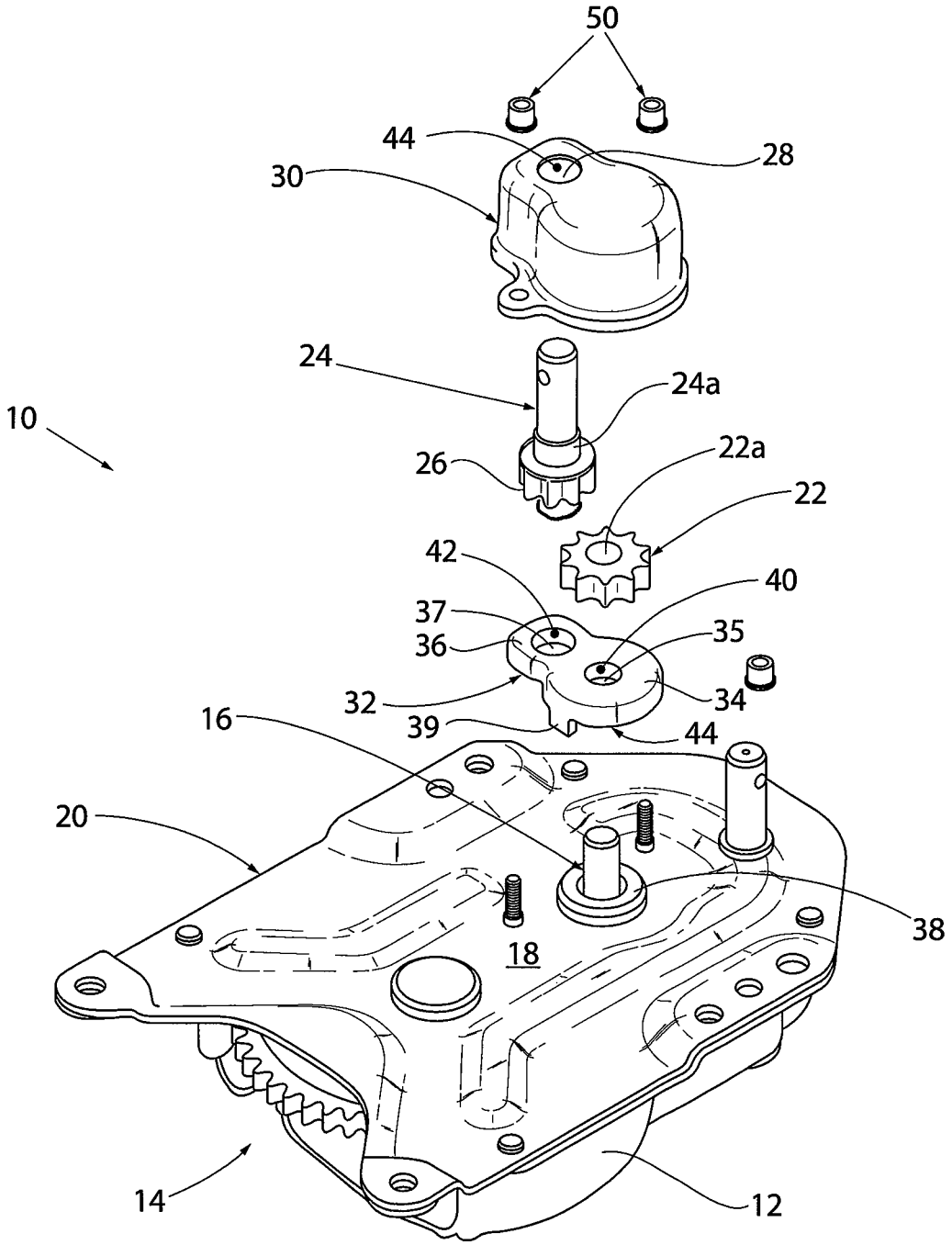
FIG. 2 is an exploded perspective view of the handbrake shown in FIG. 1.

Referring initially to FIGS. 1-2, an embodiment of a handbrake, generally indicated as 10 is shown. The handbrake 10, as described herein, is intended for connection to a frame of a railway vehicle or railway car, as will be readily apparent to those skilled in the rail vehicle art. The handbrake 10 is adapted for use in railway cars used for passenger and/or cargo transit. However, this use is intended to be non-limiting and handbrake 10 has applications in railway vehicles generally. The handbrake 10 in the embodiment shown in FIGS. 1-2 generally includes a body 12 that provides a housing for one or more gear train components, generally indicated as 14.

With continuing reference to FIG. 2, an exploded view of the handbrake 10 shows a drive shaft 16 protruding from an upper surface 18 of a back plate 20 of the handbrake 10. The drive shaft 16 is operatively connected to the gear train components 14 within the body 12 of the handbrake 10. The drive shaft 16 is also operatively connected to a pinion gear 22 via a splined connection, or a similar mechanical connection means, to cause rotation of the pinion gear 22 with the rotation of the drive shaft 16. An intermediate pinion shaft 24 is provided with an intermediate pinion shaft gear 26 that meshes with the pinion gear 22. The intermediate pinion shaft 24 protrudes through an opening 28 in a gear box housing 30.

While rotation of the drive shaft 16 about a single axis is desirable, the drive shaft 16 may rotate in an eccentric path due to manufacturing variability and/or operational wear. Such eccentric rotation of the drive shaft 16 may cause the pinion gear 22 to bind with the intermediate pinion shaft gear 26 on the intermediate pinion shaft 24. A shaft alignment link 32 is provided to prevent relative movement between the pinion gear 22 and the intermediate pinion shaft gear 26 on the intermediate pinion shaft 24. The shaft alignment link 32 engages the drive shaft 16 and the intermediate pinion shaft 24 to maintain a constant distance between the drive shaft 16 and the intermediate pinion shaft 24 that corresponds to the spacing of pitch circles of the pinion gear 22 and the intermediate pinion shaft gear 26. The shaft alignment link 32 includes a first portion 34 having a first opening 35 extending there through and an oppositely disposed second portion 36 having a second opening 37 extending there through. The first opening 35 includes a drive shaft bushing 40 that is configured to engage the drive shaft 16. The second opening 37 includes a second pinion shaft bushing 42 that is configured to engage the intermediate pinion shaft 24. Centers of the first and second openings 35, 37 are separated by a distance necessary for the proper alignment of the pitch circles of the pinion gear 22 and the intermediate pinion shaft gear 26. The shaft alignment link 32 includes stand-off protrusions 39 extending from the bottom face portion 44 that provide clearance for the rear bearing cup 38, assembled to the back plate 20 of the handbrake 10. According to one embodiment, the shaft alignment link 32 can include a minimum of three stand-off protrusions 39.

During the initial assembly of the handbrake 10, the drive shaft bushing 40 of the shaft alignment link 32 is fitted over the drive shaft 16 so that the bottom face portion 44 of the shaft alignment link 32 is positioned facing the upper surface 18 of the back plate 20 of the handbrake 10. It can be appreciated that the stand-off protrusions 39 of shaft alignment link 32 are placed in direct contact with the back plate 20 of the handbrake 10. The pinion gear 22 includes a protrusion 22*a* that is aligned and secured onto the drive shaft 16. The intermediate pinion shaft 24 is aligned and placed into the second pinion shaft bushing 42. Any eccentric movement of the drive shaft 16 is transferred to the shaft alignment link 32 such that the intermediate pinion shaft 24 is also moved. While the drive shaft 16 rotates eccentrically, relative spacing between the drive shaft 16 and the intermediate pinion shaft 24 is maintained via the shaft alignment link 32 to prevent the pinion gear 22 and the intermediate pinion shaft gear 26 from binding.

With continued reference to FIGS. 1-2, the gear box housing 30 is fitted to the handbrake 10 by a plurality of fasteners 50. The gear box housing 30 is configured to enclose at least the shaft alignment link 32 and may also enclose other gear box components. The gear box housing 30 includes a first pinion shaft bushing 44 that is fitted around an upper portion 24*a* of the intermediate pinion shaft 24. The gear box housing 30 can be secured to the upper surface 18 of the back plate 20 of the handbrake 10 with the fasteners 50.

Figure 3:
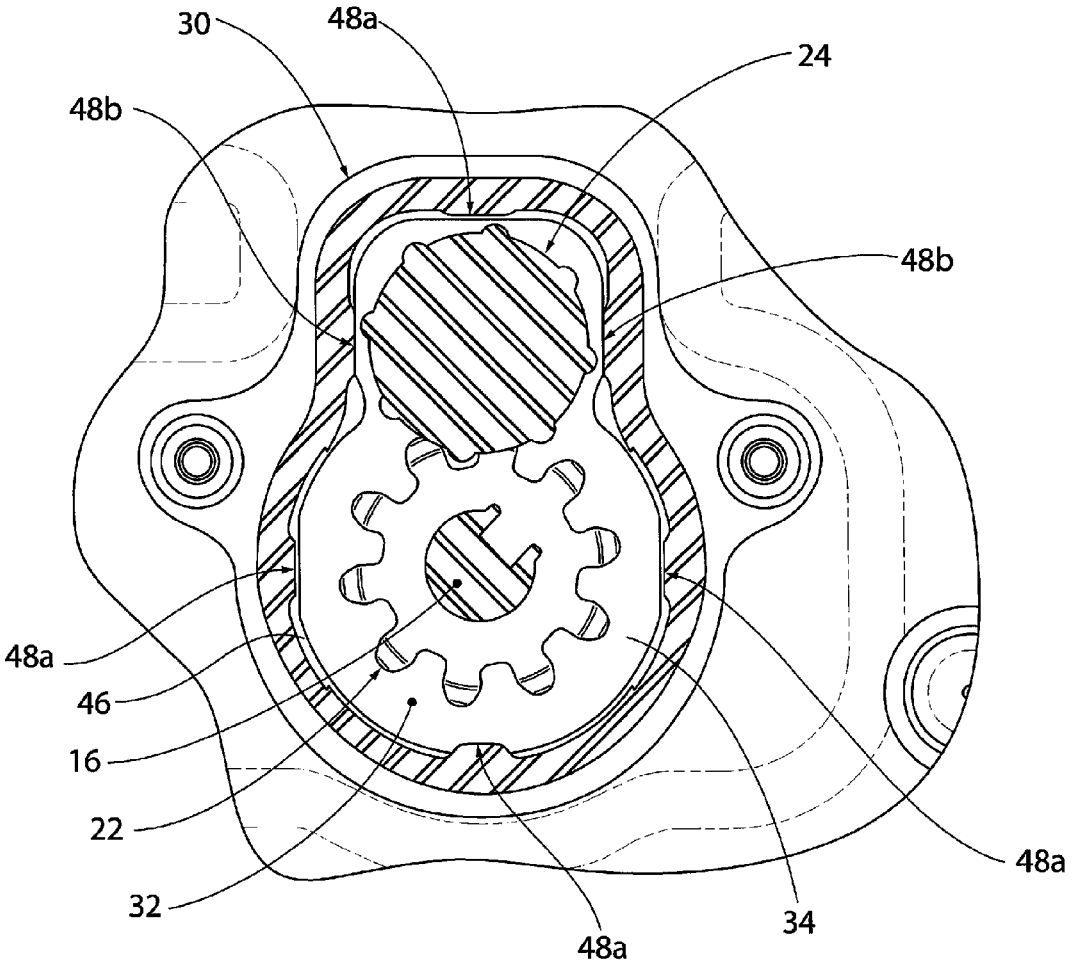
FIG. 3 is an enlarged top view of section A-A shown in FIG. 1.

With reference to FIG. 3, an enlarged top view of section A-A from FIG. 1 is shown. The shaft alignment link 32 is fixed relative to the gear box housing 30 such that a slight clearance space 46 exists therebetween. The gear box housing 30 is shaped such that it has a shape and a footprint that substantially corresponds to the shape and footprint of the shaft alignment link 32. At least a first set of ribs 48*a* are provided that extend between the gear box housing 30 and the shaft alignment link 32 which define a clearance space 46 between a portion of the gear box housing 30 and at least the first portion 34 of the shaft alignment link 32. This first set of ribs 48*a* can also include a rib extending between the gear box housing 30 and the second portion 36 of the shaft alignment link 32. Clearance space 46 is configured to allow the shaft alignment link 32 to "float" within the gear box housing 30 and with respect to the back plate 20 in order to compensate for any eccentric rotation of the drive shaft 16 and movement of the first portion 34 of the shaft alignment link with respect to the gear box housing 30. A second set of ribs 48*b* can be provided that extend between the gear box housing 30 and the shaft alignment link 32. The second set of ribs 48*b* can be a pair of ribs which are located in line with the first second pinion shaft bushing 42 as shown in FIG. 2 and associated with a second portion 36 of the shaft alignment link 32. The second set of ribs 48*b* are configured to limit rotational movement of the second portion 36 of the shaft alignment link 32 with respect to the gear box housing 30.

The first and second set of ribs 48*a*, 48*b* can be provided on the gear box housing 30 such that they extend toward the shaft alignment link 32. In an alternative embodiment, the first and second set of ribs may be provided on the shaft alignment link 32 such that they extend toward the gear box housing 30. In yet another embodiment, some of the ribs 48*a*, 48*b* can be provided on the gear box housing 30 and the remaining ribs 48*a*, 48*b* can be provided on the shaft alignment link 32.

Use of the shaft alignment link 32 to maintain the relative spacing of the drive shaft 16 and the intermediate pinion shaft 24 facilitates the alignment of the gear box components during the initial assembly process, thereby eliminating subsequent adjustments. Additionally, because the relative spacing between the gear box components does not change due to any eccentricity in drive shaft rotation, manufacturing variations in the drive shaft 16 do not increase the likelihood of gear component binding. The handbrake 10 may be installed on the railway vehicle such that it can operated from either of the lateral sides of the railway vehicle via the appropriate linkages (not shown).

In accordance with another embodiment, a method for aligning internal gear components within a handbrake 10 includes providing a handbrake body 12 having one or more gear train components 14 therein. The method further includes operatively connecting a drive shaft 16 to the one or more gear train components 14, operatively connecting an intermediate pinion shaft 24 to the drive shaft 16, and associating a shaft alignment link 32 with the drive shaft 16 and the intermediate pinion shaft 24. The shaft alignment link 32 is adapted for maintaining a relative spacing between the drive shaft 16 and the intermediate pinion shaft 24 during rotation of the drive shaft 16.

In accordance with yet another embodiment, an alignment system for use with a railway vehicle handbrake 10 includes a shaft alignment link 32 having a first portion 34 and a second portion 36. The first portion 34 has a first opening 35 extending therethrough configured for receiving the drive shaft 16. The second portion 36 has a second opening 37 extending therethrough configured for receiving the intermediate pinion shaft 24. The shaft alignment link 32 is associated with the backplate 20 of the handbrake 10. The shaft alignment link 32 maintains the relative spacing between the drive shaft 16 and the intermediate pinion shaft 24 during rotation of the drive shaft 16 within the handbrake 10. The alignment system can also include a gear box housing 30 associated with the backplate 20 of the handbrake 10 to enclose at least the shaft alignment link 32.

While various embodiments of the handbrake with a double-sided gear box were provided in the foregoing description, those skilled in the art may make modifications and alterations to these embodiments without departing from the scope and spirit of the invention. For example, it is to be understood that this disclosure contemplates that, to the extent possible, one or more features of any embodiment can be combined with one or more features of any other embodiment. Accordingly, the foregoing description is intended to be illustrative rather than restrictive. The invention described hereinabove is defined by the appended claims and all changes to the invention that fall within the meaning and the range of equivalency of the claims are to be embraced within their scope.

The invention claimed is:

1. A handbrake for a railway vehicle, comprising:

a handbrake body and a backplate, said handbrake body and back plate defining a space for containing one or more gear train components therein;

a drive shaft protruding from an upper surface of the back plate of the handbrake and outside of the space defined by the handbrake body and the back plate, said drive shaft operatively connected to the one or more gear train components;

an intermediate pinion shaft operatively connected to the drive shaft;

a shaft alignment link having a bottom face portion facing the upper surface of the back plate, said shaft alignment link associated with the drive shaft and the intermediate pinion shaft, the shaft alignment link adapted for maintaining a relative spacing between the drive shaft and the intermediate pinion shaft during rotation of the drive shaft; and a gear box housing associated with the upper surface of the back plate opposite from the space defined by the handbrake body and the back plate, the gear box housing configured to enclose at least the shaft alignment link, wherein the gear box includes an opening containing a first pinion shaft bushing therein, the opening configured to receive an upper portion of the intermediate pinion shaft.

2. The handbrake of claim 1, wherein the intermediate pinion shaft is operatively connected to the drive shaft through one or more gears.

3. The handbrake of claim 2, wherein the one or more gears comprises a pinion gear associated with the drive shaft and an intermediate pinion shaft gear associated with the intermediate pinion shaft, and wherein the shaft alignment link is adapted to prevent the pinion gear and the intermediate pinion shaft gear from binding.

4. The handbrake of claim 1, wherein the shaft alignment link includes a first portion having a first opening and a second portion having a second opening, the first opening configured for receiving the drive shaft and the second opening configured for receiving the intermediate pinion shaft.

5. The handbrake of claim 4, including a drive shaft bushing located within the first opening of the shaft alignment link and a second pinion shaft bushing located within the second opening of the shaft alignment link.

6. The handbrake of claim 1, wherein the gear box housing has a shape and footprint substantially corresponding to a shape and footprint of the shaft alignment link.

7. The handbrake of claim 1, including at least a first set of ribs extending between the gear box housing and the shaft alignment link to define a clearance space between a portion of the gear box housing and a portion of the shaft alignment link, the clearance space configured to compensate for eccentric rotation of the drive shaft and movement of the first portion of the shaft alignment link with respect to the gear box housing.

8. The handbrake of claim 7, including a second set of ribs extending between the gear box housing and the shaft alignment link, said second set of ribs associated with a second portion of the shaft alignment link, the second set of ribs configured to limit rotational movement of the second portion of the shaft alignment link with respect to the gear box housing.

9. A method for aligning internal gear components within a handbrake, said method comprising:

providing a handbrake body and a back plate, said handbrake body and back plate defining a space for containing one or more gear train components therein;

operatively connecting a drive shaft protruding from an upper surface of the back plate of the handbrake body and outside of the handbrake body, to the one or more gear train components;

operatively connecting an intermediate pinion shaft to the drive shaft;

positioning a bottom face portion of a shaft alignment link with the upper surface of the back plate and associating the shaft alignment link with the drive shaft and the intermediate pinion shaft, the shaft alignment link adapted for maintaining a relative spacing between the drive shaft and the intermediate pinion shaft during rotation of the drive shaft; and associating a gear box housing with the upper surface of the back plate opposite from the space defined by the handbrake body and the back plate, such that the gear box housing encloses at least the shaft alignment link, the gear box housing including at least one opening extending through a wall portion and containing a first pinion shaft bushing therein, said at least one opening configured for receiving an upper portion of the intermediate pinion shaft.

10. The method of claim 9, wherein the intermediate pinion shaft is operatively connected to the drive shaft through one or more gears.

11. The method of claim 10, wherein the one or more gears comprises a pinion gear associated with the drive shaft and an intermediate pinion shaft gear associated with the intermediate pinion shaft and the shaft alignment link is adapted to prevent the pinion gear and the intermediate pinion shaft gear from binding.

12. The method of claim 9, wherein the shaft alignment link includes a first portion having a first opening and a second portion having a second opening, the first opening configured for receiving the drive shaft and the second opening configured for receiving the intermediate pinion shaft.

13. The method of claim 12, including providing a drive shaft bushing within the first opening of the shaft alignment link and a second pinion shaft bushing within the second opening of the shaft alignment link.

14. The method of claim 9, including providing a first and second set of ribs between the gear box housing and the shaft alignment link, the first set of ribs defining a clearance space between a portion of the gear box housing and a portion of the shaft alignment link to compensate for eccentric rotation of the drive shaft and movement of the first portion of the shaft alignment link with respect to the gear box housing and the second set of ribs extending between the gear box housing and a second portion of the shaft alignment link to limit rotational movement of the second portion of the shaft alignment link with respect to the gear box housing.

15. An alignment system for use with a railway vehicle handbrake, the alignment system including a shaft alignment link having a first portion and a second portion, the first portion having a first opening extending therethrough configured for receiving a drive shaft, the second portion having a second opening extending therethrough configured for receiving an intermediate pinion shaft, wherein the shaft alignment link is configured to be associated with the handbrake such that the shaft alignment link maintains the relative spacing between the drive shaft and the intermediate pinion shaft during rotation of the drive shaft within the handbrake, the alignment system further including a gear box housing configured to be associated with the handbrake to enclose at least the shaft alignment link; and at least a first set of ribs located between the gear box housing and the shaft alignment link, the first set of ribs defining a clearance space between a portion of the gear box housing and a portion of the shaft alignment link to compensate for eccentric rotation of the drive shaft and movement of the first portion of the shaft alignment link with respect to the gear box housing.

16. The alignment system of claim 15, wherein the gear box housing has a shape and footprint essentially corresponding to a shape and footprint of the shaft alignment link, said gear box housing including at least one opening extending through a wall portion, said at least one opening configured for receiving an upper portion of the intermediate pinion shaft.

17. The alignment system of claim 16, including a second set of ribs located between the gear box housing and the shaft alignment link, the second set of ribs extending between the gear box housing and a second portion of the shaft alignment link to limit rotational movement of the second portion of the shaft alignment link with respect to the gear box housing.

* * * * *